US009785116B2

(12) United States Patent
Winkler et al.

(10) Patent No.: US 9,785,116 B2
(45) Date of Patent: Oct. 10, 2017

(54) TIMEPIECE REGULATING MECHANISM WITH MAGNETICALLY SYNCHRONIZED ROTATING ARMS

(71) Applicant: ETA SA Manufacture Horlogere Suisse, Grenchen (CH)

(72) Inventors: Pascal Winkler, Saint-Blaise (CH); Jean-Jacques Born, Morges (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/220,024

(22) Filed: Jul. 26, 2016

(65) Prior Publication Data

US 2017/0038730 A1 Feb. 9, 2017

(30) Foreign Application Priority Data

Aug. 4, 2015 (EP) ..... 15179711

(51) Int. Cl.
*G04B 17/20* (2006.01)
*G04C 3/08* (2006.01)
*G04C 5/00* (2006.01)

(52) U.S. Cl.
CPC ..... *G04B 17/20* (2013.01); *G04C 3/08* (2013.01); *G04C 5/005* (2013.01)

(58) Field of Classification Search
CPC ..... G04B 17/20; G04B 15/14; G04B 15/00; G04B 15/08; G04C 3/08; G04C 5/005
USPC ..... 368/202, 76, 80, 93, 125–126, 128–133, 368/158, 163, 175, 220, 223, 326
See application file for complete search history.

(56) References Cited

U.S. PATENT DOCUMENTS 2,750,730 A 6/1956 Kohlhagen
2,762,222 A 9/1956 Clifford
3,183,426 A 5/1965 Haydon
(Continued)

FOREIGN PATENT DOCUMENTS

EP 2 887 156 A1 6/2015
EP 2 889 704 A2 7/2015
WO WO 2015/096979 A2 7/2015

OTHER PUBLICATIONS

European Search Report with written opinion issued Jan. 29, 2016 in European application 15179711.5, filed on Aug. 4, 2015 (with English Translation of Categories of Cited Documents).

*Primary Examiner* — Edwin A. Leon
(74) *Attorney, Agent, or Firm* — Oblon, McClelland, Maier & Neustadt, L.L.P.

(57) ABSTRACT

A timepiece regulating mechanism including an escape wheel set subjected to a drive torque, and at least one resonator including a rigid structure connected to a plate by an elastic return and carrying at least one inertia arm cooperating with this escape wheel set via magnetically and/or electrically charged tracks comprised both in this inertia arm and in this escape wheel set, to form a synchronizing device between the escape wheel set and the resonator, and the synchronizing device is protected from loss of synchronization in the event of an accidental torque increase by a mechanical anti-desynchronization mechanism including mechanical escapement stops carried by the escape wheel set, and at least one mechanical inertia arm stop, carried by the inertia arm, and together arranged to maintain stopped in abutment in such event.

33 Claims, 5 Drawing Sheets

(56) References Cited

U.S. PATENT DOCUMENTS

| | | | | |
|---|---|---|---|---|
| 3,487,630 | A * | 1/1970 | Forty | G04B 17/285 368/129 |
| 7,394,727 | B2 * | 7/2008 | Ushikoshi | G04B 1/02 368/220 |
| 8,926,167 | B2 * | 1/2015 | Beugin | G04B 15/08 368/124 |
| 2015/0177696 | A1 | 6/2015 | Born et al. | |

* cited by examiner

TIMEPIECE REGULATING MECHANISM WITH MAGNETICALLY SYNCHRONIZED ROTATING ARMS

This application claims priority from European Patent Application No 15179711.5 filed Aug. 4, 2015, the entire disclosure of which is hereby incorporated herein by reference.

FIELD OF THE INVENTION

The invention concerns a timepiece regulating mechanism comprising a plate and, mounted to move at least in a pivoting motion with respect to said plate, an escape wheel set that pivots about an axis of escapement and is subjected to a drive torque, and at least a first resonator comprising a first rigid structure connected to said plate by first elastic return means, said first rigid structure carrying at least one inertia arm including a first inertia arm arranged to cooperate with said escape wheel set via magnetically and/or electrically charged tracks comprised in both said at least one first inertia arm and said escape wheel set, to form a synchronizing device between said escape wheel set and said at least one first resonator.

The invention also concerns a timepiece movement comprising at least one such regulating mechanism.

The invention also concerns a timepiece comprising such a movement or such a regulating mechanism.

The invention concerns the field of timepiece regulating mechanisms, particularly timepiece escapement mechanisms, and more specifically the field of contactless escapements.

BACKGROUND OF THE INVENTION

The mechanical watch movement that we know today is the result of successive improvements over the last three centuries. The Swiss lever escapement is characterized by its robustness to shocks. That is to say that the state of the watch is little affected by a one-off shock.

However, the efficiency of such an escapement is not very good (around 30%). Moreover, the Swiss lever escapement does not permit the use of resonators with a high frequency or low amplitude.

Ways are therefore sought to use resonators having a high quality factor, a high frequency, and/or low amplitude, while increasing the efficiency of the escapement and without sacrificing its robustness to shocks.

Among the embodiments relating to the field of the invention, the following are known:

the tuning fork clock developed by Clifford;

the Resonique® movement developed by De Bethune®, the Accutron® watch developed by Bulova®.

Each of these embodiments offers particular advantages, but these movements have the same drawback: they are not resistant to shocks. That is to say that, in the event of a shock, the hands rapidly gain time.

EP Patent Application 2889704A2 in the name of Nivarox-FAR SA discloses a timepiece escapement mechanism, comprising an escape wheel subjected to a rotational torque, having a moment of inertia lower than or equal to a nominal moment, about a first pivot axis, and a resonator integral with a regulating wheel set mounted to pivot about a second real or virtual pivot arbor/axis, said escape wheel comprising a plurality of actuators regularly spaced on its periphery and each arranged to cooperate directly with at least a first track of said regulating wheel set, characterized in that each said actuator includes first magnetic or electrostatic stopping means forming a barrier, and arranged to cooperate with said first track which is magnetically, or respectively electrically charged, or ferromagnetic, or respectively electrostatically conductive, to exert on said first track a torque having a moment greater than said nominal moment, and further characterized in that each said actuator also includes second stopping means arranged to form an end-of-travel stop, arranged to form an autonomous escapement mechanism with at least a first complementary stop surface comprised in said regulating wheel set.

WO Patent Application 2015/096979A2 in the name of The Swatch Group Research & Development Ltd discloses a timepiece escapement mechanism comprising a stop member between, on the one hand, a resonator, and on the other hand, two escape wheel sets each subjected to a torque, characterized in that each said escape wheel set comprises at least one magnetized or ferromagnetic, or respectively, electrically charged or electrostatically conductive track with a period of travel over which its magnetic, or respectively, electrostatic characteristics are repeated, said stop member including at least one magnetized or ferromagnetic, or respectively, electrically charged or electrostatically conductive pole piece, said pole piece being mobile in a transverse direction relative to the direction of travel of at least one element on a surface of said track, and at least said pole piece or said track creating a magnetic or electrostatic field in an air-gap between said at least one pole piece and said at least one surface, and further characterized in that said pole piece confronts a magnetic or electrostatic field barrier on said track just before each transverse motion of said stop member controlled by the periodic action of said resonator, and characterized in that said first escape wheel set subjected to a first torque and said second escape wheel set subjected to a second torque are each arranged to be capable of cooperating alternately with said stop member, and in that said first escape wheel set and said second escape wheel set pivot about distinct axes and are connected to each other by a direct kinematic connection.

U.S. Pat. No. 3,183,426A in the name of HAYDON ARTHUR describes an entirely magnetic escapement including a magnetic escape wheel, in which the energy varies continuously and progressively between minimum and maximum when the wheel turns through one half-period and then the energy returns to a minimum value over the following half-period. In other words, the magnetic force on the wheel varies progressively between a minimum (negative) and maximum (positive) value over an angular period.

SUMMARY OF THE INVENTION

The invention proposes to remedy this shortcoming of the prior art, by developing a watch, notably a mechanical watch, provided with a regulator with magnetically synchronized rotating arms and equipped with a mechanical anti-desynchronization device.

To this end, the invention concerns a regulating mechanism according to claim 1.

The invention also concerns a timepiece movement comprising at least one such regulating mechanism.

The invention also concerns a timepiece including one such movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
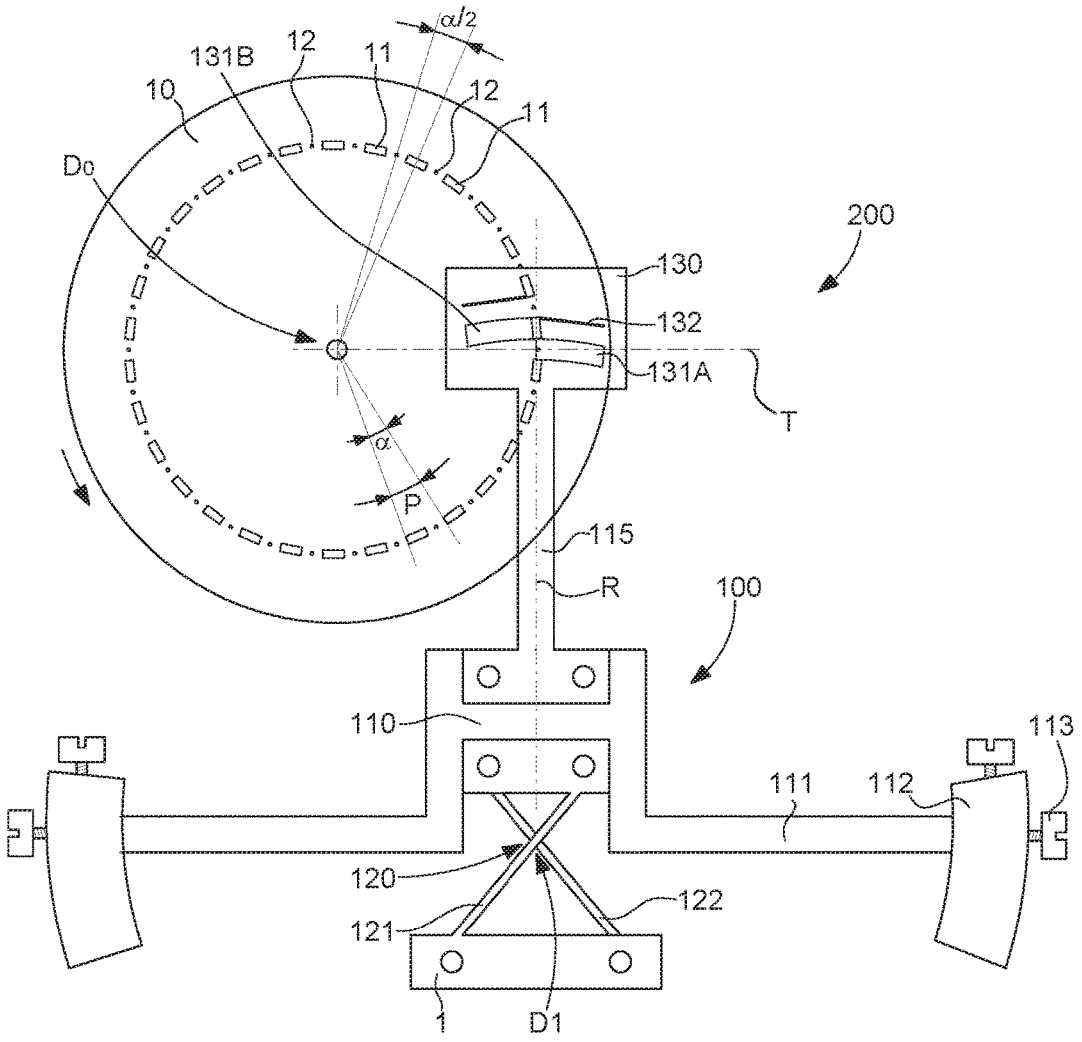
FIG. 1 shows a schematic plan view of a regulating mechanism according to the invention with a single resonator comprising an arm suspended from two flexible strips defining a virtual pivot, about which the arm pivots, the distal end of the arm comprises magnetic pole pieces, which cooperate periodically with other magnetic pole pieces comprised on the circumference of an escape wheel, this regulating mechanism is provided with an anti-desynchronization mechanism according to the invention, comprising components both on the distal end of the arm, and on the escape wheel.

The invention proposes to develop a mechanical regulating mechanism, comprising resonators having a high quality factor, a high frequency, and/or low amplitudes, while increasing the efficiency of the escapement and without sacrificing its robustness to shocks This regulating mechanism is based on at least one magnetically or electrostatically synchronized oscillator. The invention is more specifically described in the magnetic case. Those skilled in the art may refer to the other Applications made by the same Applicant, incorporated herein by reference, which describe in more detail the elements of the magnetic synchronizing interaction, and which also concern the electrostatic variant:

European Patent Application EP 14182532.3
European Patent Application EP 13199428.7
European Patent Application EP 14176816.8
European Patent Application EP 14199040.8
European Patent Application EP 14199039.0
European Patent Application PCT/EP 2014/079036
European Patent Application EP 14186261.5
European Patent Application EP 14184155.1
European Patent Application EP 13199427.9.

Thus, the invention concerns a timepiece regulating mechanism 200 comprising a main plate 1 and, mounted to move at least in a pivoting motion relative to plate 1, an escape wheel set 10 and at least a first resonator 100.

Escape wheel set 10 is illustrated here in a non-limiting manner by an escape wheel. It pivots about an axis of escapement D0, and is subjected to a drive torque, from an accumulator such as a barrel or similar element.

At least a first resonator 100 comprises a first rigid structure 110, which is connected to plate 1 by first elastic return means 120. This first rigid structure 110 carries at least one inertia arm 130 or 140. It also carries, at the ends of arm 111, inertia weights 112 carrying inertia and poising adjustment screws 113.

FIG. 1 shows a first inertia arm 130, which is arranged to cooperate with escape wheel set 10 via magnetically and/or electrically charged track comprised both in the at least one first inertia arm 130 and escape wheel set 10, to form a synchronizing device between escape wheel set 10 and the at least one first resonator 100. This arm 130 comprises a distal end bearing pole pieces, carried by a lever 115.

According to the invention, the synchronizing device is protected from loss of synchronization when there is an accidental increase in torque by a mechanical anti-desynchronization mechanism comprising mechanical escapement stops 12 carried by escape wheel set 10, and by at least one mechanical inertia arm stop 132, carried by the at least one first inertia arm 130, and together arranged to maintain stopped in abutment in the same case of accidental torque increase.

More specifically, according to the invention, the at least one first inertia arm 130 pivots about a first virtual axis D1. And said mechanical inertia arm stops 132, comprised in inertia arm 130, each extend in a direction substantially tangent to the rotating oscillating travel of inertia arm 130 about first virtual axis D1.

More specifically, in the variant of FIG. 1, the first virtual axis D1 is located at the intersection, in projection onto the plane of plate 1, of flexible strips 121 and 122 comprised in first elastic return means 120.

Figure 2:
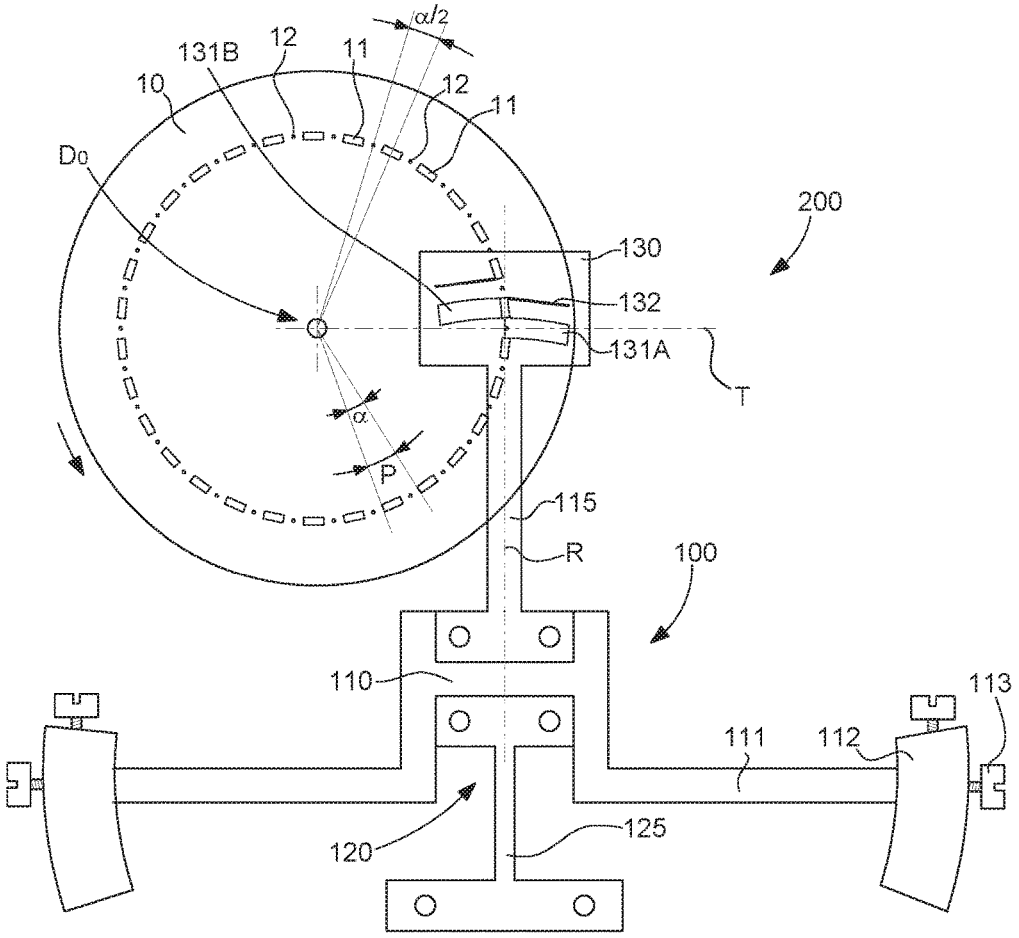
FIG. 2 is a similar assembly to that of FIG. 1, but wherein the arm is attached to the main plate of the movement by only one flexible strip.

In the variant of FIG. 2, the first virtual axis D1 is located at the rest position of a single flexible strip 125 which forms the first elastic return means 120.

In a particular, non-limiting variant, illustrated by the Figures, the magnetically and/or electrically charged track comprised in the at least one first inertia arm 130 comprises alternately at least one first inertia arm pole piece 131A and a second inertia arm pole piece 131B, which extend on either side of a radial line R originating from first virtual axis D1, and on either side of a common perpendicular T to radial line R.

More specifically, in the variant illustrated in FIGS. 1 and 2, at least one magnetically and/or electrically charged track, comprised in escape wheel set 10, includes alternating escapement pole pieces 11 and mechanical escapement stops 12, at the same pitch angle $\alpha$ with respect to axis of escapement D0.

More particularly, in these variants, the total dimensions, on radial line R, of a group formed by a consecutive first inertia arm pole piece 131A and second inertia arm pole piece 131B, along radial line R, is substantially equal to a linear pitch P which is the projection onto radial R of pitch angle $\alpha$. The distance, along radial R, between the mechanical inertia arm stops 132 corresponding to the same group, is substantially equal to half of linear pitch P.

Figure 3:
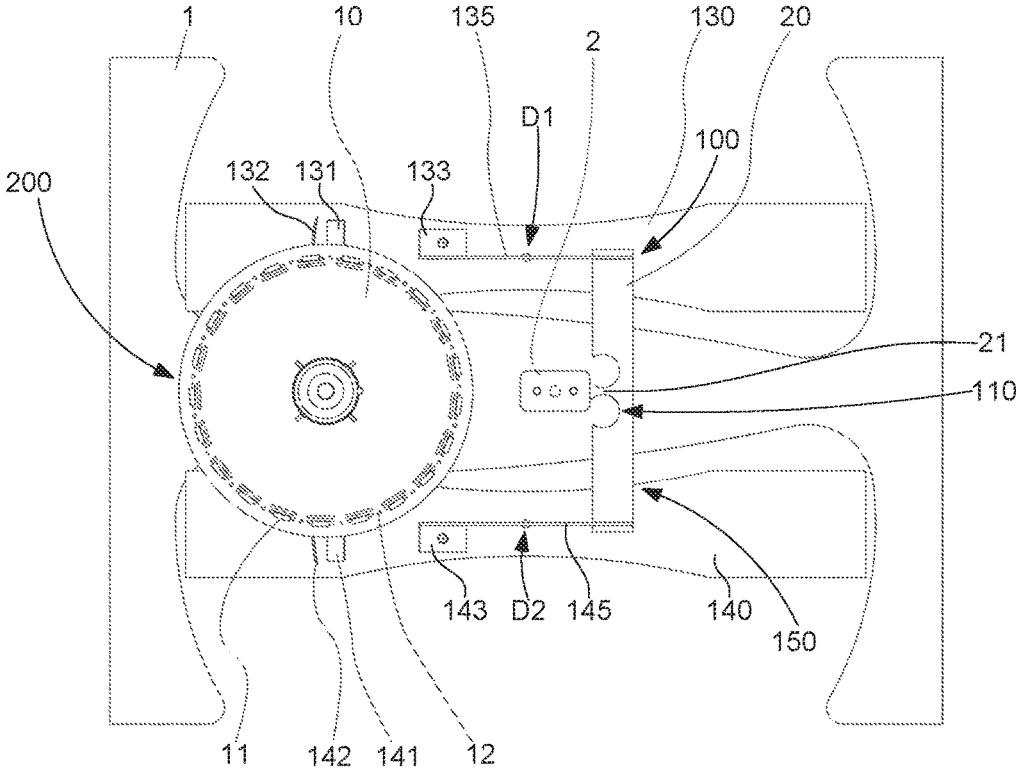
FIG. 3 is a plan view of a resonator according to the invention comprising two resonators on flexible strips operating in phase opposition.
Figure 5:
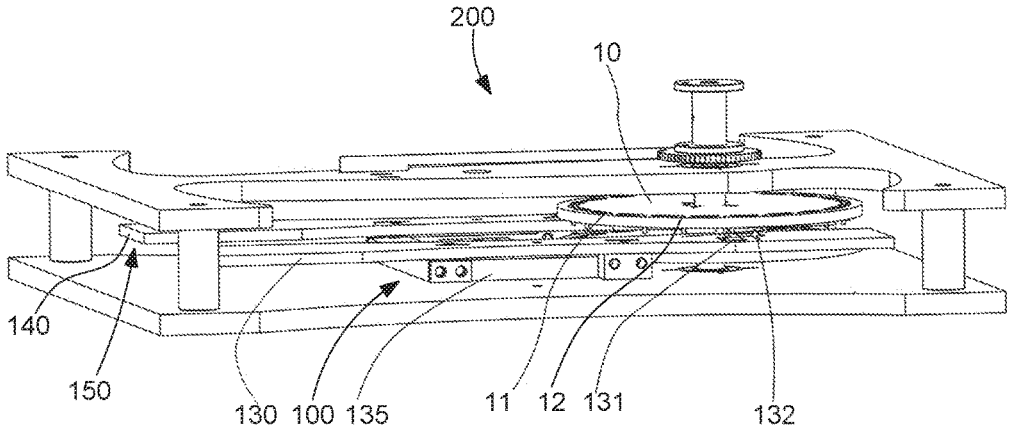
FIGS. 5 and 6 are perspective views, from different angles, of the regulating mechanism of FIG. 3.
Figure 6:
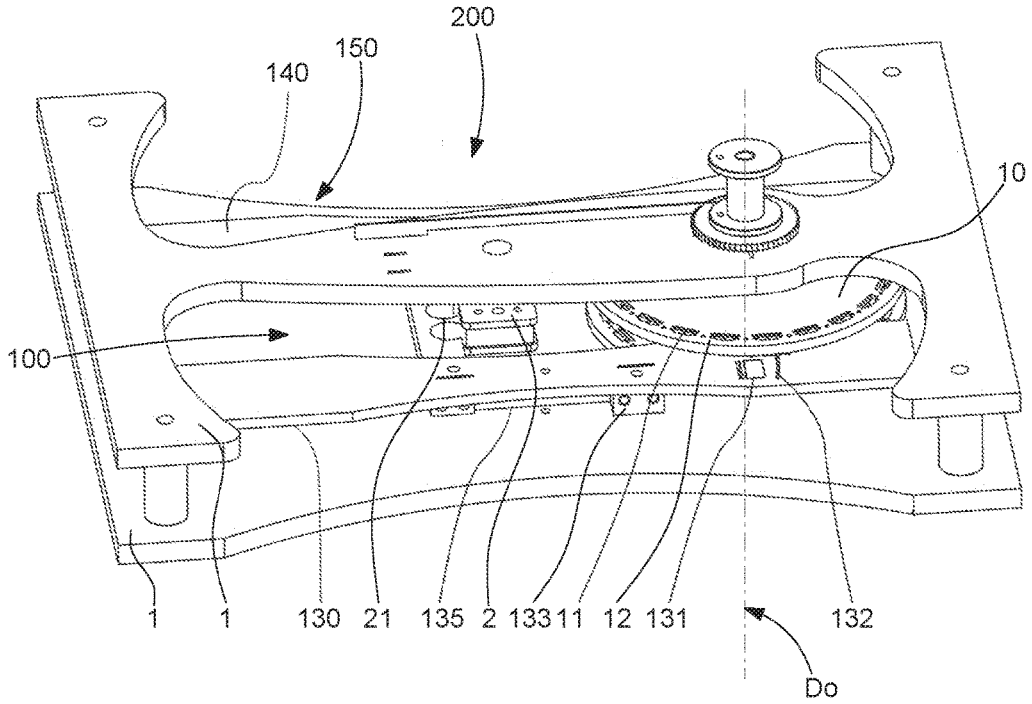

In an advantageous variant illustrated by FIGS. 3, 5 and 6, the first rigid structure 110 also carries at least one second inertia arm 140 comprised in a second resonator 150. This second inertia arm 140 pivots about a second virtual axis D2, and, like first inertia arm 130, is arranged to cooperate with escape wheel set 10 via magnetically and/or electrically charged tracks comprised both in second inertia arm 140 and escape wheel set 10. The assembly formed by first resonator 100 and second resonator 150 thus forms a tuning fork.

More specifically, the mechanical anti-desynchronization mechanism comprises at least one second mechanical inertia arm stop 142 carried by second inertia arm 140. However, the mechanism may operate with the single first stop of first arm 130.

As illustrated by the Figures, more specifically, first inertia arm 130 and second inertia arm 140 each include a fastening 133, respectively 143, for at least one flexible strip 135, respectively 145, the flexible strips 135, respectively 145, being attached at their other end to first rigid structure 110 formed by the same connecting piece 20, comprising a bending area 21, here of the type with neck portions, just at the point of rigid attachment to the plate, and secured to plate 1, in a end restraint 2.

The first inertia arm 130 and second inertia arm 140 are arranged to vibrate in phase opposition to each other. It is in this configuration that the quality factor is best In the variant of FIGS. 3, 5 and 6, first inertia arm 130 and second inertia arm 140 are arranged on either side of escape wheel set 10, and each include at least one pair formed of an inertia arm pole piece 131, 141, and a mechanical inertia arm stop 132, 142, arranged to cooperate alternately with the track of escape wheel set 10.

More specifically, at least one magnetically and/or electrically charged track comprised in escape wheel set 10 comprises alternate escapement pole pieces 11 and mechanical escapement stops 12 at the same pitch angle $\alpha$, and, in each pair, the angular distance, in projection onto the same plane perpendicular to axis of escapement D0, between the inertia arm pole piece 131, 141, and the mechanical inertia arm stop 132, 142, is equal to half of pitch angle $\alpha$.

More specifically, as illustrated, first inertia arm 130 and second inertia arm 140, and flexible strips 135, 145, extend in directions substantially parallel to each other, and orthogonal to that of connecting piece 20.

In a particular advantageous manner, each inertia arm 130, 140, is arranged to cooperate continuously with escape wheel set 10, with no periodic stopping of escape wheel set 10.

Figure 4:
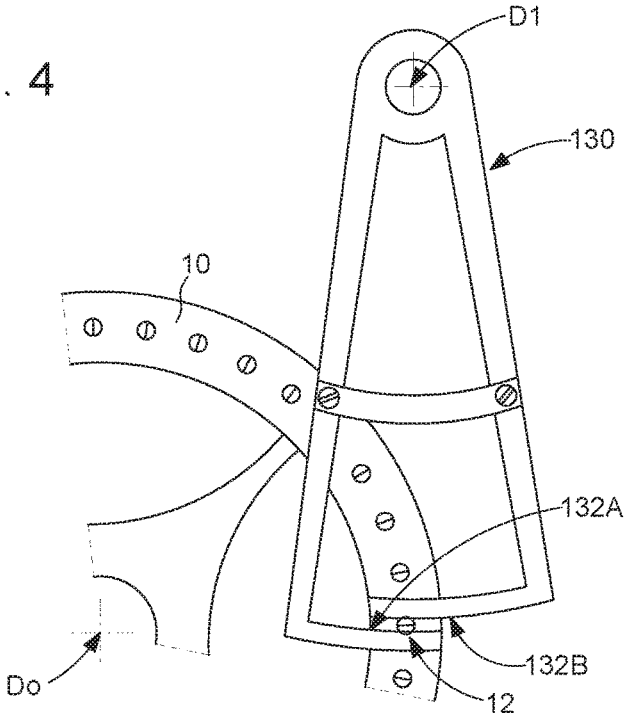
FIG. 4 is a partial plan view of a variant wherein the regulating mechanism constitutes a pin-wheel escapement mechanism of the Lepaute type.

In a particular variant, as seen in FIG. 4, regulating mechanism 200 forms a pin-wheel escapement mechanism of the Lepaute type, wherein escape wheel set 10 comprises a half-pin forming a mechanical escapement stop 12 in proximity to each escapement pole piece 11 comprised in escape wheel set 10, and wherein the at least one first inertia arm 130 comprises a mechanical inertia arm stop 132A, which is the inner surface of a first arm of a compass, and another mechanical inertia arm stop 132B corresponding to the next step which is the outer surface of a second arm of a compass. The inner surface of the first compass arm and the outer surface of said second compass arm are separated by a space of greater width than the radius of the half-pin.

In a variant, the system of mechanical stops is coplanar and comprises at least one finger arranged to cooperate radially with a toothed wheel.

In a particular, low amplitude embodiment, the angular amplitude of each inertia arm 130, 140, is less than 20°.

More specifically, at least one of inertia arms 130, 140, of the tuning fork carries two magnetic pallet stones.

More specifically, the two inertia arms 130, 140, of the tuning fork each carry at least one magnetic pallet stone.

More specifically, at least one of the inertia arms 130, 140 of the tuning fork carries two mechanical anti-desynchronization pallet stones.

More specifically, the two inertia arms 130, 140, of the tuning fork each carry at least one mechanical anti-desynchronization pallet stone.

Figure 7:
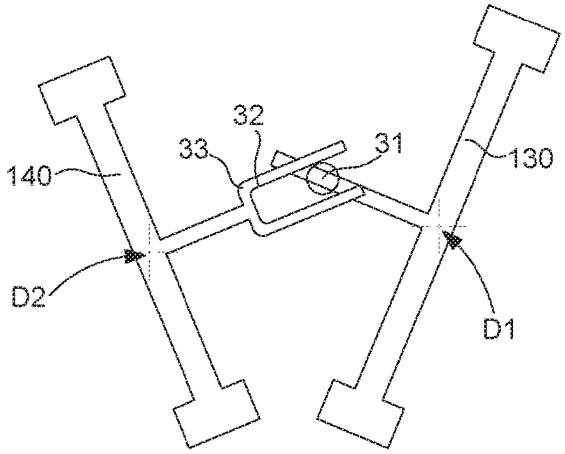
FIGS. 7 to 9 are simplified diagrams of mechanical connections forcing the rotating arms of such resonators to remain in opposition.
Figure 8:
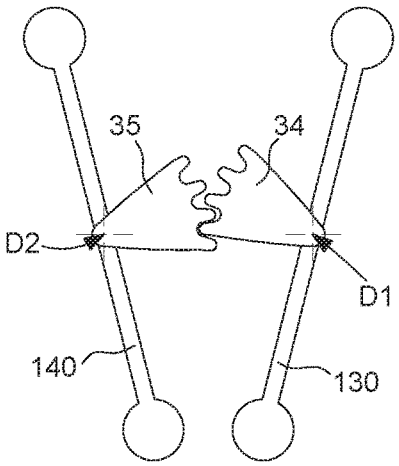
Figure 9:
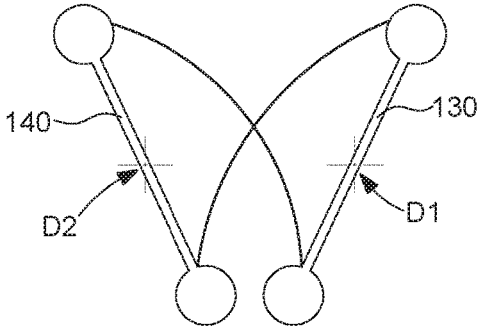
Figure 10:
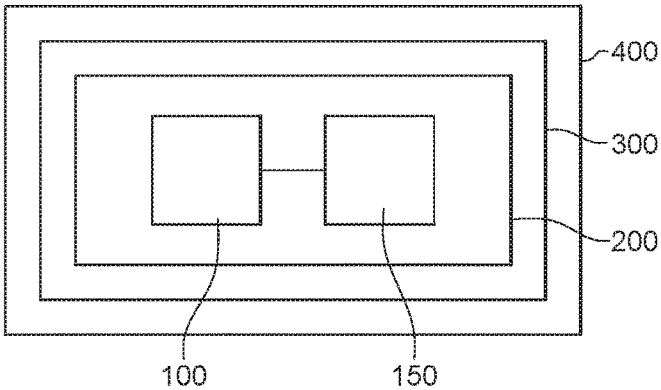
FIG. 10 is a block diagram showing a watch comprising a movement with a mechanism according to the invention having two resonators.

As seen in FIGS. 7 to 9 representing non-limiting variants, more specifically, regulating mechanism 200 comprises at least two rotating inertia arms 130, 140, wherein the phase difference of one with respect to the other is controlled by a mechanical link.

FIG. 7 illustrates the mechanical phase difference control link comprising a pin/slot mechanism, with a pin 31 integral with one arm 130 of the two inertia arms 130, 140, sliding in a slot 32 of a bracket-shaped element 33 integral with the other arm 140 of the two inertia arms 130, 140.

FIG. 7 illustrates a variant comprising at least one gear sector 34, 35, arranged to synchronize the symmetrical motions of inertia arms 130, 140, with a first toothed sector 34 integral with one arm 130 of the two inertia arms 130, 140, permanently meshing with a second toothed sector 35 integral with the other arm 140 of the two inertia arms 130, 140.

FIG. 9 illustrates a flexible mechanical link comprising flexible strips 36, 37, cross joining the opposite ends of the two inertia arms 130 and 140.

More specifically, connecting piece 20 of the two tuning fork arms is connected to plate 1 by a viscoelastic or polyurethane component, arranged to dissipate reaction forces on the support due to a temporary "windscreen wiper" mode of the tuning fork when inertia arms 130, 140 have a substantially synchronous motion.

In another variant, connecting piece 20 of the two tuning fork arms is connected to plate 1 by a friction mechanism, coupled to a means of elastic return to a neutral or rest position, and arranged to dissipate reaction forces on the support due to a temporary "windscreen wiper" mode of the tuning fork when inertia arms 130, 140 have a substantially synchronous motion.

Advantageously, at least one component of the mechanical anti-desynchronization mechanism is made of a shock absorbent material, to avoid rebounds.

As seen in FIG. 3, in a particular variant, at least one component of said mechanical anti-desynchronization mechanism is a thin pallet stone, integral with an inertia arm 130, 140, and in an arc of a circle substantially concentric to the real or virtual pivot arbor/axis, of the inertia arm 130, 140 that carries it.

In a particular variant, the mechanical anti-desynchronization mechanism comprises at least one set formed by a pallet stone of an inertial arm 130, 140, arranged to cooperate in a stop position with a pin of escape wheel set 10. The pallet stones and pins of the anti-desynchronization mechanism are arranged to intercept each other if escape wheel set 10 is forced to pivot, while the at least one first resonator 100 is maintained in its position of equilibrium.

In a particular, advantageous manner, first elastic return means 120 comprise at least one flexible strip made of oxidised silicon for thermal compensation of frequency variations.

In a particular variant, which is the easiest to implement, the synchronization is magnetic.

In a particularly advantageous application, regulating mechanism 200 forms a regulating and escapement mechanism.

The invention also concerns a timepiece movement 300 including at least one such regulating mechanism 200.

The invention also concerns a timepiece 400 comprising such a movement 300, or comprising at least one such regulating mechanism 200.

The advantage of the invention is that it makes it possible to reconcile the high efficiency offered by a magnetic synchronizing system (more than 90%), while eliminating its main defect, namely loss of synchronization in the event of high torque. Reliability is thus improved without impairing the efficiency performance.

The protection provided by this solution in the event of excessive torque is inexpensive and easy to combine with a magnetic or similar escapement.

What is claimed is:

1. A timepiece regulating mechanism comprising a plate and, mounted to move at least in a pivoting motion with respect to said plate, an escape wheel set that pivots about an axis of escapement and is subjected to a drive torque, and at least a first resonator comprising a first rigid structure connected to said plate by first elastic return means, said first rigid structure carrying at least one inertia arm including a first inertia arm arranged to cooperate with said escape wheel set via magnetically and/or electrically charged tracks comprised in both said at least one first inertia arm and said escape wheel set, to form a synchronizing device between said escape wheel set and said at least one first resonator, wherein said synchronizing device is protected from loss of synchronization in the event of an accidental increase in torque by a mechanical anti-desynchronization mechanism comprising mechanical escapement stops carried by said escape wheel set, and at least one mechanical inertia arm stop, carried by said at least one first inertia arm, and together arranged to maintain stopped in abutment in the event of an accidental torque increase, wherein said at least one first inertia arm pivots about a first virtual pivot axis, and wherein said mechanical inertia arm stops comprised in said inertia arm each extend, in a direction substantially tangent to the pivoting oscillating travel of said inertia arm about said first virtual axis, and wherein said first virtual axis is located at the intersection in projection onto the plane of said plate of flexible strips comprised in said first elastic return means.

2. The regulating mechanism according to claim 1, wherein said first virtual axis is located at the rest position of a single flexible strip which forms said first elastic return means.

3. The regulating mechanism according to claim 1, wherein said magnetically and/or electrically charged track comprised in said at least one first inertia arm comprises at least a first inertia arm pole piece and a second inertia arm pole piece, which extend on either side of a radial line originating from said first virtual axis and on either side of a common perpendicular to said radial line.

4. The regulating mechanism according to claim 3, wherein at least one said magnetically and/or electrically charged track comprised in said escape wheel set comprises alternate escapement pole pieces and mechanical escapement stops at the same pitch angle with respect to said axis of escapement.

5. The regulating mechanism according to claim 3, wherein the total dimensions, on said radial line, of a group formed by a consecutive said first inertia arm pole piece and said second inertia arm pole piece, on said radial line, is substantially equal to a linear pitch which is the projection onto said radial line of said pitch angle, and wherein the distance, on said radial line, between said mechanical inertia arm stops corresponding to said group, is substantially equal to half said linear pitch.

6. The regulating mechanism according to claim 1, wherein said first rigid structure also carries at least one second inertia arm comprised in a second resonator, said second inertia arm pivoting about a second virtual axis and, like said first inertia arm, arranged to cooperate with said escape wheel set via magnetically and/or electrically charged tracks comprised in both said at least one second inertia arm and said escape wheel set, to form a synchronizing device between said first resonator and said second resonator forming a tuning fork.

7. The regulating mechanism according to claim 6, wherein said mechanical anti-desynchronization mechanism comprises at least one second mechanical inertia arm stop carried by said second inertia arm.

8. The regulating mechanism according to claim 6, wherein said first inertia arm and said second inertia arm each include a fastening for at least one flexible strip, said flexible strips being attached at the other end thereof to said first rigid structure formed by the same connecting piece, comprising a bending area and secured to said plate in an end restraint.

9. The regulating mechanism according to claim 6, wherein said first inertia arm and said second inertia arm are arranged to vibrate in phase opposition to each other.

10. The regulating mechanism according to claim 6, wherein said first inertia arm and said second inertia arm are arranged on either side of said escape wheel set, and each include at least one pair formed of an inertia arm pole piece, and a said mechanical inertia arm stop, arranged to cooperate alternately with said track of said escape wheel set.

11. The regulating mechanism according to claim 10, wherein at least one said magnetically and/or electrically charged track comprised in said escape wheel set comprises alternate escapement pole pieces and mechanical escapement stops at the same pitch angle, and, wherein, in each pair, the angular distance, in projection onto the same plane perpendicular to said axis of escapement, between said inertia arm pole piece and said mechanical inertia arm stop, is equal to half of said pitch angle.

12. The regulating mechanism according to claim 8, wherein said first inertia arm and said second inertia arm and said flexible strips, extend in directions substantially parallel to each other, and orthogonal to that of said connecting piece.

13. The regulating mechanism according to claim 1, wherein each said inertia arm is arranged to cooperate continuously with said escape wheel set, with no periodic stopping of said escape wheel set.

14. The regulating mechanism according to claim 1, wherein said regulating mechanism forms a pin-wheel escapement mechanism of the Lepaute type, wherein said escape wheel set comprises a half-pin forming a said mechanical escapement stop in proximity to each escapement pole piece comprised in said escape wheel set, and wherein said at least one first inertia arm comprises a said mechanical inertia arm stop, which is the inner surface of a first arm of a compass, and another mechanical inertia arm stop corresponding to the next step which is the outer surface of a second arm of a compass, said inner surface of said first compass arm and said outer surface of said second compass arm being separated by a space of greater width than the radius of said half-pin.

15. The regulating mechanism according to claim 1, wherein said mechanical stop system is coplanar and comprises at least one finger arranged to cooperate radially with a toothed wheel.

16. The regulating mechanism according to claim 1, wherein the angular amplitude of each said inertia arm is less than 20°.

17. The regulating mechanism according to claim 8, wherein at least one of said inertia arms of said tuning fork carries two magnetic pallet stones.

18. The regulating mechanism according to claim 8, wherein said two inertia arms of said tuning fork each carry at least one magnetic pallet stone.

19. The regulating mechanism according to claim 8, wherein at least one of said inertia arms of said tuning fork carries two mechanical anti-desynchronization pallet stones.

20. The regulating mechanism according to claim 8, wherein said two inertia arms of said tuning fork each carry at least one mechanical anti-desynchronization pallet stone.

21. The regulating mechanism according to claim 6, wherein said regulating mechanism comprises at least two said rotating inertia arms whose phase difference with respect to each other is controlled by a mechanical link.

22. The regulating mechanism according to claim 21, wherein said mechanical phase difference control link comprises a pin/slot mechanism, with a pin integral with one of the two said inertia arms sliding in a slot in a bracket-shaped element integral with the other of the two said inertia arms.

23. The regulating mechanism according to claim 21, wherein said mechanical phase difference control link comprises at least one gear sector, arranged to synchronize the symmetrical motions of said inertia arms, with a first toothed sector integral with one of the two said inertia arms, permanently meshing with a second toothed sector integral with the other of said two inertia arms.

24. The regulating mechanism according to claim 21, wherein said mechanical phase difference control link is a flexible mechanical link comprising flexible strips cross joining the opposite ends of the two said inertia arms.

25. The regulating mechanism according to claim 8, wherein said connecting piece of the two tuning fork arms is connected to said plate by a viscoelastic or polyurethane component, arranged to dissipate reaction forces on the support due to any temporary "windscreen wiper" mode of said tuning fork when said inertia arms have a substantially synchronous motion.

26. The regulating mechanism according to claim 8, wherein said connecting piece of the two tuning fork arms is connected to said plate by a friction mechanism, coupled to a means of elastic return to a neutral position, and arranged to dissipate reaction forces on the support due to any temporary "windscreen wiper" mode of said tuning fork when said inertia arms have a substantially synchronous motion.

27. The regulating mechanism according to claim 1, wherein at least one component of said mechanical anti-desynchronization mechanism is made of a shock absorbent material to prevent rebounds.

28. The regulating mechanism according to claim 1, wherein said mechanical anti-desynchronization mechanism comprises a set formed by a pallet stone of a said inertia arm, arranged to cooperate in a stop position with a pin of said escape wheel set, and wherein said pallet stones and pins of said anti-desynchronization mechanism are arranged to intercept each other if said escape wheel set is forced to pivot while said at least one first resonator is maintained in a position of equilibrium.

29. The regulating mechanism according to claim 1, wherein said first elastic return means comprise at least one flexible oxidised silicon strip for thermal compensation of frequency variations.

30. The regulating mechanism according to claim 1, wherein said synchronization is magnetic.

31. The regulating mechanism according to claim 1, wherein the mechanism forms a regulating and escapement mechanism.

32. A timepiece movement including at least one regulating mechanism according to claim 1.

33. A timepiece including at least one regulating mechanism according to claim 1 and/or comprising a movement comprising at least one regulating mechanism.

* * * * *